United States Patent [19]

Suda et al.

[11] 4,030,607

[45] June 21, 1977

[54] FLAT-ARTICLE SEPARATING APPARATUS FOR AN AUTOMATIC MAIL HANDLING SYSTEM AND THE LIKE

[75] Inventors: Kazuyoshi Suda; Tomoyuki Isono; Takashi Uchida; Kiyoshi Tsuda, all of Tokyo, Japan

[73] Assignee: Nippon Electric Co., Ltd., Tokyo, Japan

[22] Filed: Apr. 29, 1975

[21] Appl. No.: 572,808

[30] Foreign Application Priority Data

Apr. 30, 1974 Japan ..... 49-48502

[52] U.S. Cl. ..... 209/74 R; 209/75; 209/82; 209/DIG. 1; 271/64; 271/259; 271/263

[51] Int. Cl.[2] ..... B07C 5/06

[58] Field of Search ..... 209/73, 74 R, 75, 82, 209/88 S, DIG. 1; 271/64, 259, 263; 33/148 H

[56] References Cited

UNITED STATES PATENTS

| | | | |
|---|---|---|---|
| 2,171,362 | 8/1939 | Gulliksen | 271/259 X |
| 3,180,122 | 4/1965 | Evans et al. | 209/82 X |
| 3,287,015 | 11/1966 | Preuss et al. | 271/259 |
| 3,430,951 | 3/1969 | Hulka et al. | 271/64 |
| 3,659,840 | 5/1972 | Ruck | 271/64 |
| 3,669,263 | 6/1972 | Babb | 209/82 |
| 3,680,692 | 8/1972 | Southworth | 209/82 X |

*Primary Examiner*—Robert B. Reeves
*Assistant Examiner*—Joseph J. Rolla
*Attorney, Agent, or Firm*—Sughrue, Rothwell, Mion, Zinn & Macpeak

[57] ABSTRACT

An automatic flat-article separating apparatus for mail handling is disclosed. The apparatus has an article transport path, an ejecting route, a suction belt, a thickness detector installed on the transport path and a roller assembly for compressing the flat article to the suction belt. The thickness detector determines the acceptable limits of the material passing on the transport path and when the article is within that predetermined range, the roller is activated to compress the flat article.

7 Claims, 3 Drawing Figures

FLAT-ARTICLE SEPARATING APPARATUS FOR AN AUTOMATIC MAIL HANDLING SYSTEM AND THE LIKE

BACKGROUND OF THE INVENTION

1. Field of the Invention

This invention relates to an automatic flat-article separating apparatus for use in an automatic mail-handling system and the like.

2. Prior Art

An automatic feeding apparatus for flat articles such as cards, envelopes and postcards, is designed, as shown in the U.S. Pat. No. 2,952,457 to feed the flat articles one by one. In such an apparatus, a plurality of flat articles are often transported as they are overlapped with each other. Such overlap-feeding causes errors in the automatic mail handling system. To guarantee an accurate mail handling, the overlapped flat articles must be separated from each other.

For this purpose, various kinds of flat-article separating apparatuses have been proposed. One of those conventional apparatuses comprises a feed route for feeding the flat articles along an article transport path, an ejecting route installed in the downstream end of the transport path and a suction belt means disposed on the way of the transport path for transporting the flat articles fed from the feed route to a regular route. With such apparatus, the flat articles fed from the feed route are individually sucked and directed into the regular route by the suction belt means and, in the event that any two overlapping flat articles are fed in, they are separated from each other as the upper pieces is sucked and directed into the regular route by the suction belt means while the lower piece proceeds free of any suction thereof straight into the ejecting route.

Such conventional apparatus, however, has involved a disadvantage that any flat articles which are more or less thick and hence hardly flexible tend to proceed straight into the ejecting route even if they satisfy the requirements for their delivery into the regular route because of the limited attractive force exerted by the suction belt means on the flat articles.

SUMMARY OF INVENTION

It is therefore, an object of this invention to provide an improved automatic flat-article separating apparatus which not only serves the function of separating any two overlapped flat articles from each other but is also capable of delivering any more or less thick individual flat articles into the regular route efficiently without fail.

According to this invention, there is provided an improved automatic flat-article separating apparatus comprising a fed route, an article transport path, an ejecting route, a suction belt means, a thickness detector installed on the way of the transport path for detecting the thickness of the flat article, and a roller means for compressing the flat article to the suction belt means. The roller means is driven to compress the flat article, only when the detected thickness is in a predetermined range.

BRIEF DESCRIPTION OF DRAWINGS

The features and advantages of this invention will be better understood from the following detailed description of a preferred embodiment of this invention taken in conjunction with the accompanying drawings, wherein.

Figure 1:
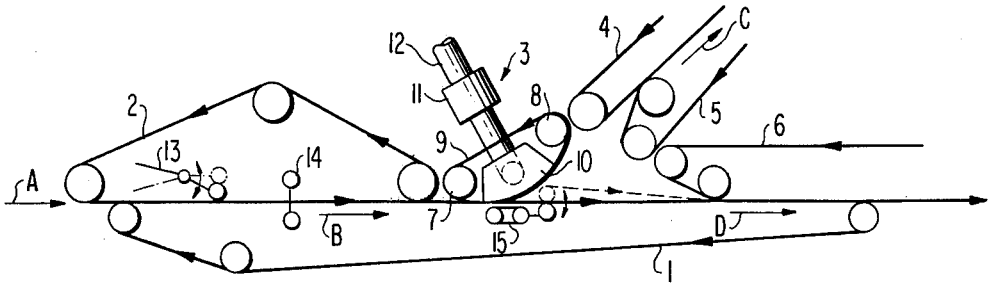
FIG. 1 is a schematic view of a preferred embodiment of this invention.

Referring first to FIG. 1, an embodiment of this invention comprises endless belts 1 and 2 arranged opposite to each other so as to form a transport path B in association with a feed route A. Flat articles fed from the feed route A are transported along the transport path B in a condition embraced between the belts 1 and 2. Those articles which meet the requirements for automatic handling or processing are sucked and transported by a suction belt transporting mechanism 3 to be delivered into a regular route C, which is formed of a pair of endless belts 4 and 5, while any unacceptable articles are allowed to proceed free of any suction effect of the suction belt transporting mechanism 3 straight into an ejecting route D, which is formed of an endless belt 6 and the endless belt 1.

The suction belt transporting mechanism 3 may be of any conventional form and, as illustrated, includes an apertured endless belt 9 entrained about a pair of spaced belt pulleys 7 and 8 and a suction chamber 10 which cooperates with the belt 9 to cause a vacuum pressure on the front face of the belt 9 through the apertures formed therein. The suction chamber 10 is connected to an appropriate vacuum pump (not shown) through a pipe 12 provided with an air valve 11 thereon. The air valve 11 is normally held open to maintain the interior of the suction chambers 10 at a vacuum pressure.

There are arranged along the transport path B a thickness detector 13 for serving the purpose of detecting the thickness of incoming flat articles and a length detector 14 for serving the purpose of detecting the length and spacing of the flat articles. The thickness detector 13 is designed to determine whether the flat articles have a thickness within a specified range or not and operable to produce a thickness signal each time the flat article has passed through. It is to be noted that the thickness signal is utilized to control operation of a moving roller 15, arranged opposite to the suction belt transporting mechanism 3, and the air valve 11.

Further, the length detector 14 is designed to determine whether the length of flat article is within a specified range or not and also whether the incoming flat articles are fully spaced from each other and is operable to produce a rejection signal each time it detects a mail length outside the specified range or an insufficient mail spacing. The rejection signal is utilized to control the air valve 11, too.

Figure 2:
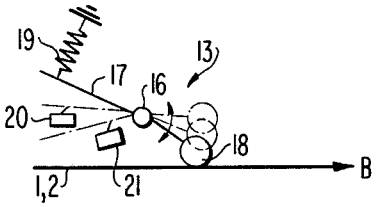
FIG. 2 is a side view of the thickness detector employed in the embodiment shown in FIG. 1.

As shown in FIG. 2, the thickness detector 13 includes a lever 17 rockably supported at a fulcrum point 16, a roller 18 rotatably mounted on the lever 17 at one end thereof, and a spring 19 arranged to bias the lever 17 in a direction to press the roller 18 against the back surface of the belt 2. Also, a pair of limit switches 20 and 21 are arranged so as to be actuated by the lever 17 as the latter is rocked against the bias of spring 19 to respective predetermined extents.

Figure 3:
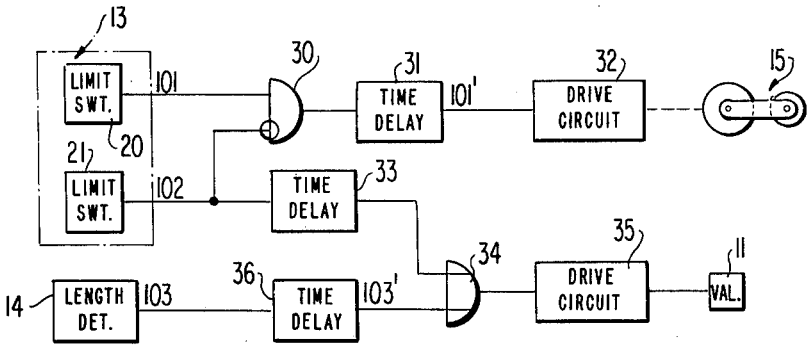
FIG. 3 is a block diagram of the electrical control system of the embodiment shown in FIG. 1.

Description will next be made of the operation of the embodiment with reference to FIG. 3.

If a flat article being transported along the transport path B is thin (for example, less than 3 mm in thickness, the amount of rocking movement of detector lever 17 is so limited that both of detector switches 20 and 21 are left inoperative and no thickness signal is produced at the thickness detector 13. Under this situation, the flat article is directed into the regular route C under the action of the suction belt transporting mechanism 3 unless a rejection signal 103 is produced at the length detector 14. Further, if the flat article is somewhat thicker, having a thickness within the predetermined range (for example, of 3 to 6 mm), only one of the detector switches 20, is operated by the rocking lever 17 to produce a first thickness signal 101, which is transmitted through an inhibit circuit 30 to a delay circuit 31, which is set with a delay time corresponding to the period of time required for flat articles to travel between the thickness detector 13 and the moving roller 15. The first thickness signal 101, delayed by the delay circuit 31, is further transmitted to a roller driving circuit 32 associated with the moving roller 15 so that the roller is driven to compress the adjacent portion of the belt 1. Therefore, the incoming flat article of a thickness within the specified range, is deflected into contacting engagement with the working face of the suction belt transporting mechanism 3 and thus directed efficiently into the regular route C without any danger of proceeding straight into the ejecting route D.

If the incoming flat article happens to have a thickness larger than the upper limit (for example, 6 mm) of the specified thickness range, both of detector switches 20 and 21 are actuated by the rocking lever 17 to produce first and second thickness signals 101 and 102, respectively. The first thickness signal 101, however, is negated as the second thickness signal 102 is led to the inhibit terminal of the inhibit circuit 30 and the moving roller 15 remains inoperative. On the the other hand, the second thickness signal 102 is first delayed at a delay circuit 33 by an amount of time corresponding to the period of time required for the flat article to travel from the thickness detector 13 to the vicinity of the suction belt transporting mechanism 3. The delayed second thickness signal is applied through an OR circuit 34 to an air valve drive circuit 35. Accordingly, the air valve 11 is closed to cut off the vacuum input to the suction chamber 10, thus rendering the suction belt transporting mechanism 3 ineffective. In this manner, if will be apparent that, for any flat article having an unusually large thickness, not only the moving roller 15 remains inoperative but also the suction belt transporting mechanism 3 is rendered ineffective, allowing such flat article to proceed straight into the ejecting route D.

In the event that the incoming flat article is longer than the prescribed value or its spacing from the preceding flat article is insufficient, the length detector 14 produces a rejection signal 103, which is directed to a delay circuit 36 to be delayed by an amount of time corresponding to the period of time required for flat articles to travel from the length detector 14 to the vicinity of the suction belt transporting mechanism 3. The delayed rejection signal 103' is directed through the OR circuit 34 to the air valve drive circuit 35, whereby the air valve 11 is closed, to render the suction belt transporting mechanism ineffective so that the flat article is allowed to proceed straight into the ejecting route D.

It will be apparent from the foregoing that, according to the present invention, not only thin flat articles but also those of larger thicknesses such as not to be effectively sucked and directed by the suction belt transporting mechanism into the regular output route can be delivered therein without fail as long as they have an appropriate thickness to be automatically handled, that is, a thickness within a specified range, for example, of 3 to 6 millimeters.

While one preferred embodiment of the present invention has been shown and described, it will be apparent to those skilled in the art that many changes and modifications may be made therein without departing from the spirit of the invention or from the scope of the appended claim.

What is claimed is:

1. A flat-article separating apparatus for an automatic mail handling system, comprising:

means for feeding flat articles along an article transport path;

means installed on said transport path for sucking and transporting said flat article from said transport path on to a regular route;

means disposed upstream of said sucking means for detecting the thickness of said flat article, said thickness detecting means including first and second limit switches, said switches having first and second predetermined limits wherein at least two ranges of flat article thickness may be sensed, one where said first and second limits are exceeded and a second where said first limit is exceeded but not said second limit;

means disposed near said sucking means and responsive to said detecting means for compressing said flat article to the sucking means, and a control circuit responsive to said first and second limit switches to actuate said compressing means when said thickness detected by said detecting means is within said second range.

2. The apparatus of claim 1 wherein said control circuit includes means to delay the activation of said compressing means until said article is passing on said transport path over said compressing means.

3. The apparatus of claim 1, wherein said control circuit includes means for inactivating said sucking means when both of said limit switches are actuated and means for delaying the inactivation of said sucking means until said flat article is on said transport path below said sucking means.

4. The apparatus of claim 3 wherein said control circuit includes means for inactivating said compressing means when both of said limit switches are actuated.

5. The apparatus of claim 1 including means to determine the length of said flat article located on said transport path upstream from said sucking means.

6. The apparatus of claim 5 including control circuit means for inactivating said sucking means when said length determining means produces an indication that said flat article is longer than the prescribed value.

7. The apparatus of claim 5 wherein said means for detecting length also senses the spacing between flat articles on said transport path.

* * * * *